US011016403B2

(12) United States Patent
Nakamura et al.

(10) Patent No.: US 11,016,403 B2
(45) Date of Patent: May 25, 2021

(54) ELECTROPHOTOGRAPHIC PHOTOCONDUCTOR, IMAGE FORMING APPARATUS, AND PROCESS CARTRIDGE

(71) Applicants: Hideki Nakamura, Yamanashi (JP); Tadayoshi Uchida, Yamanashi (JP); Shuya Sugimoto, Yamanashi (JP); Mitsuaki Hirose, Shizuoka (JP); Noboru Toriu, Shizuoka (JP); Kaori Harada, Yamanashi (JP)

(72) Inventors: Hideki Nakamura, Yamanashi (JP); Tadayoshi Uchida, Yamanashi (JP); Shuya Sugimoto, Yamanashi (JP); Mitsuaki Hirose, Shizuoka (JP); Noboru Toriu, Shizuoka (JP); Kaori Harada, Yamanashi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/742,952

(22) Filed: Jan. 15, 2020

(65) Prior Publication Data

US 2020/0233325 A1 Jul. 23, 2020

(30) Foreign Application Priority Data

Jan. 17, 2019 (JP) ..... JP2019-006047

(51) Int. Cl.
*G03G 5/00* (2006.01)
*G03G 5/087* (2006.01)
(Continued)

(52) U.S. Cl.
CPC ..... *G03G 5/087* (2013.01); *G03G 5/047* (2013.01); *G03G 5/056* (2013.01); *G03G 5/144* (2013.01); *G03G 21/18* (2013.01)

(58) Field of Classification Search
CPC ..... G03G 5/144; G03G 5/047; G03G 5/056
(Continued)

(56) References Cited

U.S. PATENT DOCUMENTS 10,466,604 B2 * 11/2019 Toshine ..... G03G 5/144
2009/0311616 A1 12/2009 Shimoyama et al.
(Continued)

FOREIGN PATENT DOCUMENTS

JP 2002-341570 11/2002
JP 2003-066636 3/2003
(Continued)

*Primary Examiner* — Mark A Chapman
(74) *Attorney, Agent, or Firm* — Oblon, McClelland, Maier & Neustadt, L.L.P.

(57) ABSTRACT

An electrophotographic photoconductor is provided that includes a conductive substrate, an undercoat layer overlying the conductive substrate, and a photosensitive layer overlying the undercoat layer. The undercoat layer contains zinc oxide particles and a binder resin and has a volume resistivity of $0.03\times10^6$ Ω·cm or less in an electrical field of 5 V/μm at a temperature of 23 degrees C. and a relative humidity of 55%. The photosensitive layer contains a compound represented by the following general formula (1):

General Formula (I)

(Continued)

where each of $R_1$ to $R_3$ independently represents a hydrogen atom, a halogen atom, an alkyl group having 1 to 6 carbon atoms which may have a substituent, or a substituted or unsubstituted aryl group having 6 to 12 carbon atoms.

6 Claims, 3 Drawing Sheets

(51) Int. Cl.
*G03G 5/05* (2006.01)
*G03G 5/047* (2006.01)
*G03G 21/18* (2006.01)
*G03G 5/14* (2006.01)

(58) Field of Classification Search
USPC ..... 430/63
See application file for complete search history.

(56) References Cited

U.S. PATENT DOCUMENTS

2010/0150606 A1 6/2010 Tamoto et al.
2010/0178074 A1 7/2010 Nakatake et al.
2010/0233602 A1 9/2010 Yamamoto et al.
2010/0260513 A1 10/2010 Kawasaki et al.
2010/0290807 A1 11/2010 Shimoyama et al.
2010/0330475 A1 12/2010 Tamoto et al.
2011/0059393 A1 3/2011 Tamoto et al.
2011/0286777 A1 11/2011 Sugino et al.
2012/0321348 A1 12/2012 Toriu et al.
2013/0022902 A1 1/2013 Shimoyama et al.
2013/0059242 A1 3/2013 Asano et al.
2013/0059243 A1 3/2013 Hirose et al.
2013/0157181 A1 6/2013 Kurimoto et al.
2013/0243483 A1 9/2013 Hirose et al.
2013/0251401 A1 9/2013 Asano et al.
2013/0330104 A1 12/2013 Shimoyama et al.
2016/0187792 A1 6/2016 Toriu et al.
2017/0212435 A1 7/2017 Hirose et al.
2019/0011845 A1 1/2019 Toshine et al.

FOREIGN PATENT DOCUMENTS

JP 2003-084472 3/2003
JP 2003-098705 4/2003
JP 2007-047467 2/2007
JP 2007-322996 12/2007
JP 2008-096527 4/2008
JP 2008-299020 12/2008

* cited by examiner

ELECTROPHOTOGRAPHIC PHOTOCONDUCTOR, IMAGE FORMING APPARATUS, AND PROCESS CARTRIDGE

CROSS-REFERENCE TO RELATED APPLICATIONS

This patent application is based on and claims priority pursuant to 35 U.S.C. § 119(a) to Japanese Patent Application No. 2019-006047, filed on Jan. 17, 2019, in the Japan Patent Office, the entire disclosure of which is hereby incorporated by reference herein.

BACKGROUND

Technical Field

The present disclosure relates to an electrophotographic photoconductor, an image forming apparatus, and a process cartridge.

Description of the Related Art

An image forming method using an image forming apparatus generally performs the steps of charging, irradiating, developing, and transferring on a photoconductor to form an image.

In recent years, organic photoconductors using organic materials have been widely used for their advantages in flexibility, thermal stability, and film formability.

With the rapid progress of image forming apparatus in terms of full-colorization, speeding up, and higher definition, photoconductors have been required to be more durable and stable, and wear resistance of the photoconductors have been dramatically enhanced by improving the surface layer such as a protective layer. On the other hand, the internal layers of the photoconductor, such as a photosensitive layer, an intermediate layer, and an undercoat layer, are required to have electrical and chemical durability and stable electrical properties to be resistant to changes in usage environment.

The organic materials constituting the photoconductor gradually change in quality due to electrostatic load received in a typical electrophotographic process in which a process of charging and a process of removing charges are repeated. As a result, electrical properties of the photoconductor deteriorate, and electrical stability thereof cannot be maintained when the photoconductor is used for a long period of time. In particular, a decrease in chargeability has a large effect on the output image quality and is known to cause serious problems such as a decrease in image density, background fouling (hereinafter also referred to as background stains, fogging, and black spots), and image inhomogeneity during continuous output. It is considered that the undercoat layer of the photoconductor has a great influence on these phenomena and improvement of the undercoat layer leads to improvement of durability and stability of the photoconductor.

In general, an organic photoconductor comprises a conductive substrate made of aluminum or the like, an undercoat layer formed on the substrate, and a photosensitive layer laminated on the undercoat layer. The undercoat layer is a conductive layer containing a binder resin and conductive particles such as metal oxide particles as major components. The undercoat layer has the following three functions: "leakage resistance function" by hiding the surface of the substrate, "charge injection blocking function" for blocking charge injection from the substrate to the photosensitive layer", and "charge transport function" for transporting charges generated in the photosensitive layer to the substrate, all of which are required more improvements.

In recent years, electrophotographic technology has been remarkably developed, and electrophotographic photoconductors are required to have better properties. For example, demand for color images such as photographs has increased in place of conventional black-and-white images such as texts, and requirements for their image quality has been increasing year by year.

However, conventional photoconductors cause problems such as residual image, residual potential, and post-exposure potential increase when used in a full-color electrophotographic apparatus or an electrophotographic apparatus with no charge-eliminating light emitter. In particular, when used in an electrophotographic apparatus with no charge eliminating device, a strong residual image is undesirably generated from the initial stage.

The residual image is particularly likely to appear in a halftone image, which causes a large problem in a color image that is often a superimposition of halftone images.

In the case of a full-color image, even if the degree of residual image of each color image is the same as that of a monochrome image, the residual images are likely to become clearer as a plurality of color images are superimposed.

It is possible to prevent generation of residual image by provision of a pre-irradiation charge eliminating device in an electrophotographic apparatus. However, the charge eliminating device is often omitted for cost reduction and miniaturization of the electrophotographic apparatus.

Conventional technologies are insufficient for such a severe situation in solving the problem of residual image.

Therefore, a photoconductor has not been proposed that has an undercoat layer having the leakage resistance function, the charge injection blocking function, and the charge transport function, that has stable electrical properties even when used for a long period of time, and that prevents generation of residual image during image formation.

SUMMARY

In accordance with some embodiments of the present invention, an electrophotographic photoconductor is provided. The electrophotographic photoconductor comprises a conductive substrate, an undercoat layer overlying the conductive substrate, and a photosensitive layer overlying the undercoat layer. The undercoat layer contains zinc oxide particles and a binder resin and has a volume resistivity of $0.03\times10^6$ Ω·cm or less in an electrical field of 5 V/μm at a temperature of 23 degrees C. and a relative humidity of 55%. The photosensitive layer contains a compound represented by the following general formula (I):

General Formula (I)

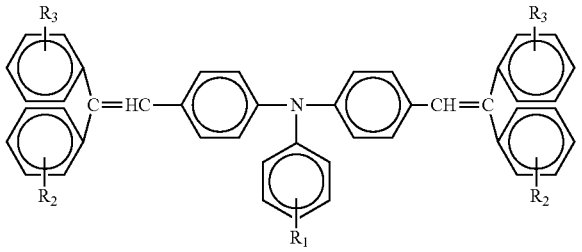

where each of $R_1$ to $R_3$ independently represents a hydrogen atom, a halogen atom, an alkyl group having 1 to 6 carbon atoms which may have a substituent, or a substituted or unsubstituted aryl group having 6 to 12 carbon atoms.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
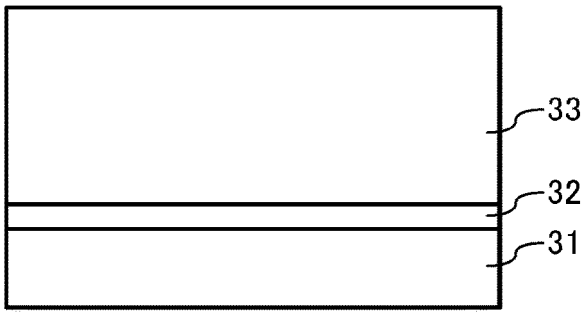
FIG. 1 is a schematic diagram for explaining the layer structure of a photoconductor according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

In accordance with some embodiments of the present invention, an electrophotographic photoconductor is provided that prevents generation of residual image during image formation even when used for a long period of time.

The present invention is achieved based on the finding that an electrophotographic photoconductor that has an undercoat layer having a volume resistivity within a specific range and a photosensitive layer containing a charge transport material having a specific structure prevents generation of residual image during image formation even when used for a long period of time.

Embodiments of the present invention are described in detail below.

Electrophotographic Photoconductor

The electrophotographic photoconductor (hereinafter simply referred to as "photoconductor") according to an embodiment of the present invention includes a conductive substrate, an undercoat layer overlying the conductive substrate, and a photosensitive layer overlying the undercoat layer. The photoconductor may further include other layers, as necessary.

The undercoat layer contains specific materials, and the photosensitive layer contains a compound (charge transport material) represented by the general formula (I). Thus, the photoconductor prevents generation of residual image during image formation even when used for a long period of time.

The electrophotographic photoconductor according to an embodiment of the present invention may further contain various conventionally-known materials and components.

The mechanism of preventing generation of residual image is considered as follows.

In an electrophotographic process, an image is formed through the steps of charging, irradiating, developing, transferring, re-charging, and writing. In the charging step, the surface of the photoconductor is negatively charged. In the subsequent irradiating step, the photoconductor is irradiated with light, and light is absorbed by the charge material of the charge generation layer, thereby generating charge carriers (holes). The charge carriers move through the charge transport layer and combine with negative charges on the surface of the photoconductor to disappear. As a result, the negatively-charged surface potential is canceled in the portion exposed to light and a charge distribution is generated, thereby forming an electrostatic latent image.

In the developing step, a toner having a negative charge is adhered to the portion where the electric charge has been canceled and the potential has been lowered. To transfer the adhered toner having a negative charge to a paper medium, in the transfer step, a positively charged electric field is applied to the surface of the photoconductor. On the surface of the photoconductor, there are a portion where toner is adhered and a portion where toner is not adhered, and a positive charge is applied thereto during transfer. At this time, the positive charge is injected from the surface of the photoconductor into the film of the charge transport layer and trapped therein. As the trapped positive charge is canceled by the negative charge in the next recharging step, a potential difference is generated in the negatively charged surface of the photoconductor, and the potential difference is expressed as a residual image in the writing step.

To solve the above-described problem, the undercoat layer cancels the positive charge trapped in the charge transport layer from the conductive substrate side after the transferring step, thus reducing the trapped charge. Thus, the potential difference generated in the next recharging step is reduced, and as a result, generation of residual image is prevented.

Further, the charge transport material represented by the general formula (I) acts on the positive charge trapped in the charge transport layer in the transferring step to control the energy (ionization potential) of the charge transport layer to be shifted to a low ionization energy side. As a result, positive charge injection from the charge transport layer to the charge generation layer is prevented and generation of residual image is effectively prevented even when the photoconductor is used for a ling period of time.

Undercoat Layer

The undercoat layer contains metal oxide particles and a binder resin, and may further contain other components, as necessary.

The undercoat layer has the leakage resistance function by completely hiding the conductive substrate with a homogeneous film, the charge injection blocking function for blocking injection of unnecessary charges (i.e., charges having the reverse polarity to the charge polarity of the photoconductor) from the conductive substrate to the photosensitive layer, and the charge transport function for transporting charges having the same polarity as the charge polarity of the photoconductor among the charges generated in the photosensitive layer. To be stable over an extended period of time, the photoconductor does not change these properties even under repeated exposure to electrostatic loads.

As a result of intensive studies by the inventors of the present invention, it has been found that these properties are achieved when the undercoat layer contains zinc oxide particles and a binder resin and has a volume resistivity of $0.03\times10^6$ Ω·cm or less in an electrical field of 5 V/μm at a temperature of 23 degrees C. and a relative humidity of 55%.

The reason why all the functions necessary for the undercoat layer are achieved by this configuration is not clear but can be considered as follows.

Zinc oxide particles have excellent electrical properties. When the volume resistivity of the undercoat layer is $0.03\times10^6$ Ω·cm or less when an electrical field of 5 V/μm is applied at a temperature of 23 degrees C. and a relative humidity of 55%, it is considered that the undercoat layer acquires excellent charge injection blocking function and charge transport function, and the photoconductor maintains reliable image properties even when used for a long period of time or under environmental changes.

Preferably, the undercoat layer is formed as a dispersion film in which zinc oxide particles are uniformly dispersed. The undercoat layer has a transmittance of 50% or more within a wavelength range of from 500 to 800 nm when the film thickness is 10 μm. When the lowest transmittance within this wavelength range is 85% or less, it is considered that uniform dispersibility of zinc oxide is maintained. When aggregates of zinc oxide particles are present in the undercoat layer to cause light scattering and inhibit light transmission, these aggregates become local leakage points and cause abnormal images such as background fouling. In addition, the aggregates cause charge trapping to increase residual potential.

On the other hand, zinc oxide particles are likely to be deteriorated due to fine wear or cracks caused by the force applied during the dispersing process. As a result, electrical properties of the zinc oxide particles are deteriorated, the resistance of the undercoat layer is increased, and the excellent electrical properties cannot be maintained.

Therefore, in preferred embodiments of the present invention, zinc oxide particles which are surface-treated with an alkyl alkoxysilane in which the alkyl group that is bonded to Si has 4 or less carbon atoms are used.

When zinc oxide particles are surface-treated with the alkyl alkoxysilane in which the alkyl group has 4 or less carbon atoms, the zinc oxide particles are prevented from deteriorating in the dispersing process and formed into a very uniform dispersion state.

The alkyl alkoxysilane in which the alkyl group has 4 or less carbon atoms has a strong binding force with zinc oxide particles. Therefore, deterioration of the zinc oxide particles in the dispersing process is prevented, the affinity of the zinc oxide particles for the organic solvent or the binder resin is improved, and the cohesive force between the zinc oxide particles is reduced. As a result, the zinc oxide particles are uniformly dispersed in the undercoat layer, and the undercoat layer maintains excellent electrical properties and leakage resistance function.

In another preferred embodiment of the present invention, the undercoat layer contains a salicylic acid derivative or a thiol-group-containing compound.

When a thiol-group-containing compound or a salicylic acid derivative is contained, a uniform dispersion state of the zinc oxide particles and the above-described volume resistivity are achieved at the same time.

Zinc Oxide Particles

The zinc oxide particles are not particularly limited and can be suitably selected to suit to a particular application. Two or more types with different properties may be used in combination.

Method for Preparing Zinc Oxide Particles

The zinc oxide particles used in the present disclosure may be prepared by known methods, and methods called wet methods are preferred. The wet methods are of two major types. One is a method in which an aqueous solution of a zinc compound (typically zinc salt) such as zinc sulfate and zinc chloride is neutralized with a soda ash solution, and the resulting zinc carbonate is washed with water, dried, and calcined. The other is a method in which zinc hydroxide particles are produced, washed with water, dried, and calcined. In the wet methods, the content of a specific element can be intentionally changed by selection of raw materials and production conditions, which leads to easy production of zinc oxide particles used in the present disclosure.

Details of the wet methods are described below.

In the wet methods, a precipitate is produced from a zinc-containing aqueous solution and an alkaline aqueous solution. The precipitate is aged and washed, then wetted with an alcohol and dried, thus obtaining zinc oxide particle precursors. The zinc oxide particle precursors are burnt to become zinc oxide particles. The zinc compound for preparing the zinc-containing aqueous solution is not particularly limited. Examples thereof include, but are not limited to, zinc nitrate, zinc chloride, zinc acetate, and zinc sulfate. Preferably, zinc oxide used in the present disclosure is prepared from zinc sulfate so as to contain sulfur derived from sulfuric acid.

Examples of the alkaline aqueous solution include, but are not limited to, aqueous solutions of sodium hydroxide, calcium hydroxide, ammonium hydrogen carbonate, and ammonia. In preparing zinc oxide used in the present disclosure, a mixed system of sodium hydroxide, ammonium hydrogen carbonate, and calcium hydroxide is particularly preferred. The concentration of sodium hydroxide in the alkaline aqueous solution is preferably an excess amount of, specifically from 1.0 to 1.5 times of, the chemical equivalent necessary for the zinc compound to become a hydroxide. When the amount of alkali is equal to or more than the chemical equivalent, the zinc compound is able to react. When the amount of alkali is equal to or less than 1.5 times or less of the chemical equivalent, the cleaning time for removing residual alkali is shortened.

Next, production and aging of the precipitate is described below.

The precipitate is produced by dropping a zinc compound aqueous solution into an alkaline aqueous solution that is continuously stirred. As the zinc compound aqueous solution is dropped into the alkaline aqueous solution, supersaturation is instantaneously achieved to produce a precipitate. Thus, fine particles of zinc carbonate and zinc carbonate hydroxide having a uniform particle diameter are obtained as precipitates.

When the alkaline aqueous solution is dropped into the zinc compound aqueous solution or when the zinc compound aqueous solution and the alkaline aqueous solution are dropped in parallel, it is difficult to obtain such fine particles of zinc carbonate and zinc carbonate hydroxide having a uniform particle diameter as precipitates. The temperature of the alkaline aqueous solution at the time when a precipitate is produced is not particularly limited, but is generally 50 degrees C. or less, and is preferably room temperature. The lower limit of the temperature of the alkaline aqueous solution is not limited. However, if the temperature is too low, a heating equipment is necessary. Thus, the temperature of the alkaline aqueous solution is preferably adjusted to a temperature that does not need any heating equipment. The time period for dropwise addition of the zinc compound aqueous solution into the alkaline aqueous solution is less than 30 minutes, preferably 20 minutes or less, and more preferably 10 minutes or less, for productivity. After completion of the dropwise addition, aging is performed with continuous stirring to make the system uniform. The aging temperature is the same as the temperature during precipitation. The time period for continuous stirring is not particularly limited, but is 30 minutes or less, preferably 15 minutes or less, for productivity.

The precipitate obtained after the aging is washed by decantation. It is possible to adjust the amount of sulfate ions remaining in the fine particles by adjusting the conductivity of the washing solution. This makes it possible to control the contents of sodium, calcium, and sulfur in the resulting zinc oxide. Next, the washed precipitate is wet-treated with an alcohol solution to obtain a wet-treated product. The wet-treated product is then dried to obtain zinc oxide particle precursors. The wet treatment avoids aggregation of the zinc oxide particle precursors after drying. The alcohol concentration in the alcohol solution is preferably 50% by mass or more. When the alcohol concentration is 50% by mass or more, the zinc oxide particles are prevented from becoming strong aggregates and exhibit excellent dispersibility.

The alcohol solution used in the wet treatment is described below.

The alcohol used for the alcohol solution is not particularly limited. Preferred examples thereof include water-soluble alcohols having a boiling point of 100 degrees C. or less. Specific examples thereof include, but are not limited to, methanol, ethanol, propanol, and tert-butyl alcohol.

The wet treatment is described below.

The wet treatment may be performed by putting the filter-washed precipitate into the alcohol solution and stirring them. The time taken for this treatment and the stirring speed may be appropriately selected according to the treatment amount. The amount of the alcohol solution into which the precipitate is put is a liquid amount that makes it easy to stir the precipitate and ensures fluidity. The stirring time and stirring speed are appropriately selected so that the precipitate partially containing a portion which has been aggregated during the filter-washing is uniformly mixed in the alcohol solution until the aggregated portion is eliminated.

The wet treatment is generally performed at room temperature. The wet treatment may also be performed under heat, if necessary, unless the alcohol is not lost by evaporation. Preferably, the heat temperature is equal to or lower than the boiling point of the alcohol, so as to avoid disappearance of the alcohol during the wet treatment and not to lose the effect of the wet treatment.

The presence of the alcohol during the wet treatment makes the wet treatment effective and prevents the precipitate from becoming a strong aggregate after drying, which is preferable.

A method for drying the wet-treated product is described below.

Drying conditions such as drying temperature and time are not particularly limited, and heat-drying may be started in a state in which the wet-treated product it wet with the alcohol. After the wet treatment, the precipitate never becomes a strong aggregate even in heat-drying. Therefore, the drying conditions may be appropriately selected depending on the treatment amount of the wet-treated product, the treatment apparatus, and the like.

The zinc oxide particle precursors get wet-treated by this drying treatment and then become zinc oxide particles by burning.

The burning of the dried zinc oxide particle precursors is performed in the air or in an atmosphere of an inert gas (such as nitrogen gas, argon gas, and helium gas) or a mixed gas (such as a mixture of the inert gas with a reducing gas such as hydrogen gas). The lower limit of the treatment temperature is preferably around 400 degrees C. for desired ultraviolet absorbing (shielding) properties. The treatment time is appropriately selected according to the treatment amount of the zinc oxide precursors and the burning temperature.

Average Particle Diameter of Zinc Oxide Particles

The particle diameter (volume average particle diameter) of the zinc oxide particles can be appropriately selected to suit to a particular application. Preferably, the average particle diameter is from 20 to 200 nm, and more preferably from 50 to 150 nm. When the average particle diameter is less than 20 nm, it may be difficult to form an undercoat layer in a good dispersion state. When the average particle diameter exceeds 200 nm, it may be difficult to maintain excellent electrical properties of the undercoat layer.

The average particle diameter of the zinc oxide particles is determined as follows. First, 100 randomly-selected particles contained in the undercoat layer are observed with a transmission electron microscope (TEM). The projected area of each particle is measured, and the equivalent circle diameter thereof is determined as the volume average particle diameter of the particle. The average of the volume average particle diameters of the 100 particles is treated as the average particle diameter.

Volume Occupancy of Zinc Oxide Particles in Undercoat Layer

The volume occupancy of the zinc oxide particles in the undercoat layer is not particularly limited and can be suitably selected to suit to a particular application, but is preferably from 40% to 55%, more preferably from 45% to 53%. When the volume occupancy is 40% or more, the volume resistivity of the undercoat layer is not excessively increased. Electric properties of the undercoat layer can be maintained at a proper level. When the volume occupancy is 55% or less, the zinc oxide particles are finely dispersed and the transmittance of the layer is high, providing sufficient background fouling resistance.

The volume occupancy of the zinc oxide particles is calculated from the added amounts and specific gravities of zinc oxide, resin components, and optional components.

Surface Treatment Agent

Preferred examples of the surface treatment agent for surface-treating the zinc oxide particles include an alkyl alkoxysilane having an alkyl group having 4 or less carbon atoms. In this case, deterioration of the zinc oxide particles is prevented in the dispersing process and a very uniform dispersion state is formed in the undercoat layer. Specific examples of the surface treatment agent include, but are not limited to, methyltrimethoxysilane, dimethyldimethoxysilane, trimethylmethoxysilane, methyltriphenoxysilane, ethyltrimethoxysilane, n-propyltrimethoxysilane, diisopropyldimethoxysilane, isobutyltrimethoxysilane, diisobutyldimethoxysilane, methyltriethoxysilane, dimethyldiethoxysilane, and n-propyltriethoxysilane. Each of these can be used alone or in combination with others.

When the surface treatment agent for surface-treating the zinc oxide particles is an alkyl alkoxysilane having an alkyl group having 5 or more carbon atoms, the cohesive force between the molecules of the surface treatment agents is increased, and it becomes more difficult to disperse the zinc oxide particles. Furthermore, since the alkyl chain is long, steric hindrance occurs between the molecules of the surface treatment agent, resulting in insufficient treatment on the surface of the zinc oxide particles. As a result, dispersibility and electrical properties are not achieved at the same time.

Moreover, other surface treatment agents may be used in combination with the alkyl alkoxysilane having an alkyl group having 4 or less carbon atoms. The other surface treatment agents are not particularly limited and can be suitably selected to suit to a particular application.

Examples thereof include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Each of these can be used alone or in combination with others.

A method for treating the zinc oxide particles with the surface treatment agent is not particularly limited and can be suitably selected to suit to a particular application. Examples thereof include, but are not limited to, dry methods and wet methods.

Dry Method

The dry method may include the processes of stirring the zinc oxide particles with a mixer having a large shearing force, dropping the surface treatment agent directly or dropping an organic solvent solution of the surface treatment agent, and spraying the zinc oxide particles together with dry air or nitrogen gas. Preferably, the dropping of the surface treatment agent and the spraying are performed at a temperature not higher than the boiling point of the organic solvent. When the spraying is performed at a temperature higher than the boiling point of the organic solvent, the organic solvent evaporates before a uniform stirring is achieved and the surface treatment agent gets solidified locally, which may make it difficult to perform a uniform treatment. After the dropping of the surface treatment agent and the spraying, a baking may be performed at 100 degrees C. or higher. The baking temperature and time are not particularly limited and can be suitably selected to suit to a particular application as long as desired electrophotographic properties are obtained.

Wet Method

The wet method may include the processes of dispersing the zinc oxide particles in a solvent by means of stirring, ultrasonic waves, a sand mill, an attritor, or a ball mill, adding the surface treatment agent thereto, followed by stirring or dispersing, then removing the solvent. The solvent may be removed by, for example, filtration or distillation.

After the solvent has been removed, baking may be performed at 100 degrees C. or higher. The baking temperature and time are not particularly limited and can be suitably selected to suit to a particular application as long as desired electrophotographic properties are obtained. The wet method may further include the process of removing moisture contained in the zinc oxide particles before addition of the surface treatment agent. Moisture may be removed by, for example, stirring and heating the zinc oxide particles in a solvent used for the surface treatment, or causing an azeotropic phenomena with the solvent.

Whether the surfaces of the zinc oxide particles are coated with the surface treatment agent or not may be confirmed by surface analysis methods such as photoelectron spectroscopy (ESCA), Auger electron spectroscopy, time-of-flight secondary ion mass spectrometry (TOF-SIMS), and Fourier transform infrared spectroscopy (FT-IR).

Thiol-Group-Containing Compound

Examples of the thiol-group-containing compound include, but are not limited to, ethanethiol, 1-propanethiol, 2-propanethiol, 2-mercaptoethanol, 1-butanethiol, 2-butanethiol, 2-methyl-1-propanethiol, 2-methyl-2-propanethiol, 1,2-ethanedithiol, cyclopentanethiol, 3-methyl-1-butanethiol, 2-methyl-1-butanethiol, 3-methyl-2-butanethiol, 1-pentanethiol, 1,3-propanedithiol, 1,2-propanedithiol, 1-hexanethiol, 1-heptanethiol, 1,5-pentanedithiol, 2-ethyl-1-hexanethiol, tert-octanethiol, 1,6-hexanedithiol, 2-propene-1-thiol, thioacetic acid, 2-aminoethanethiol, mercaptoacetic acid, 2-(methylthio)ethanol, 3-mercapto-1-propanol, thiolactic acid, 3-mercaptopropionic acid, methyl thioglycolate, 3-mercapto-2-butanol, 3-mercapto-1,2-propanediol, 3-mercapto-2-pentanone, 2-mercapto-3-pentanone, 2,3-dimercapto-1-propanol, 3-mercapto-1-hexanol, 6-mercapto-1-hexanol, benzenethiol, 2-pyridinethiol, 4-pyridinethiol, 2-pyrimidinethiol, p-xylenethiol, m-xylene-4-thiol, 2-ethylbenzenethiol, (4-methylphenyl)methanethiol, 2-methoxybenzenethiol, 1,2-benzenedithiol, toluene-3,4-dithiol, 3-(trimethoxysilyl)propanethiol, 3-(triethoxysilyl)propanethiol, 3-(dimethoxymethylsilyl)-1-propanethiolpentaerythritol tetrakis(3-mercaptobutyrate), 1,4-bis(3-mercaptobutyryloxy)butane, 1,3,5-tris(3-mercaptobutyryloxyethyl)-1,3,5-triazine-2,4,6(1H, 3H, 5H)-trione, trimethylolpropane tris(3-mercaptobutyrate), and trimethylolethane tris(3-mercaptobutyrate).

Salicylic Acid Derivative

Examples of the salicylic acid derivative include, but are not limited to, salicylic acid, acetylsalicylic acid, 5-acetylsalicylic acid, 3-aminosalicylic acid, 5-acetylsalicylamide, 5-aminosalicylic acid, 4-azidosalicylic acid, benzyl salicylate, 4-tert-butylphenylsalicylate, butyl salicylate, 2-carboxyphenylsalicylate, 3,5-dinitrosalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methylsalicylate, 3-methylsalicylic acid, 4-methylsalicylic acid, 5-methylsalicylic acid, methyl thiosalicylate, 4-nitrophenylsalicylate, 5-nitrosalicylic acid, 4-nitrosalicylic acid, 3-nitrosalicylic acid, 4-octylphenylsalicylate, phenylsalicylate, 3-acetoxy-2-naphthanilide, 6-acetoxy-2-naphthoic acid, 3-amino 2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naphthoate, and phenyl 1-hydroxy-2-naphthoate.

Each of these may be used alone or two or more of these may be used in combination.

Proportion of Thiol-Group-Containing Compound and Salicylic Acid Derivative

The proportion of the thiol-group-containing compound or salicylic acid derivative to the zinc oxide particles before the treatment is preferably from 0.3% to 6% by mass, more preferably from 1.5% to 4.0% by mass, and much more preferably from 1% to 3% by mass. When the proportion of the thiol-group-containing compound or salicylic acid derivative to the zinc oxide particles before the treatment is 0.3% by mass or more, the thiol-group-containing compound or salicylic acid derivative can sufficiently exhibit its functions to provide good properties. When the proportion of the thiol-group-containing compound or salicylic acid derivative to the zinc oxide particles before the treatment is 6% by mass or less, good properties are provided without inhibiting dispersion of the zinc oxide particles.

Each of these can be used alone or in combination with others.

Binder Resin

The binder resin not particularly limited and can be suitably selected to suit to a particular application. Examples thereof include, but are not limited to, thermoplastic resins and thermosetting resins. Each of these can be used alone or in combination with others. In particular, a resin having high resistance to general organic solvents is preferred as the binder resin, since a photosensitive layer (described later) is to be applied onto the undercoat layer. Examples of the binder resin having high solvent resistance include, but are not limited to, water-soluble resins such as polyvinyl alcohol, casein, and sodium polyacrylate; alcohol-soluble resins such as copolymer nylon and methoxymethylated nylon; and curable resins that form a three-dimensional network structure, such as polyurethane, melamine resin, phenol resin, alkyd melamine resin, and epoxy resin.

These binder resins are cured at different temperatures when formed into a film. The higher the temperature, the more the curing is accelerated with a concern that the volume resistance of the binder resin itself is increased. In the present disclosure, alkyd melamine resins are preferred. This is because, in curing the undercoat layer containing zinc oxide particles, the influence of the volume resistance of the binder resin can be reduced under a temperature of about 130 degrees C.

The ratio of the zinc oxide particles to the alkyd melamine binder resin in the undercoat layer is preferably from 84.6/15.4 to 86.7/13.3, more preferably from 85.3/14.7 to 86.1/13.9, for improving the effect of the present invention.

Other Components

The undercoat layer may further contain other components for improving electrical properties, environmental stability, and image quality.

The other components are not particularly limited and can be suitably selected to suit to a particular application. Examples thereof include, but are not limited to, electron transport materials, electron transport pigments of polycyclic condensation type and azo type, silane coupling agents, zirconium chelate compounds, titanium chelate compounds, aluminum chelate compounds, fluorenone compounds, titanium alkoxide compounds, organic titanium compounds, and antioxidants, plasticizers, lubricants, ultraviolet absorbers, and leveling agents to be described later.

Each of these can be used alone or in combination with others.

The method for dispersing the zinc oxide particles in the undercoat layer coating liquid is not particularly limited and can be suitably selected to suit to a particular application. Examples thereof include, but are not limited to, dispersion methods using a ball mill, a sand mill, a vibration mill, a three-roll mill, an attritor, a pressure homogenizer, or a ultrasonic disperser.

The coating method is not particularly limited and can be appropriately selected depending on the viscosity of the coating liquid, the desired film thickness of the undercoat layer, or the like. Examples thereof include, but are not limited to, dip coating, spray coating, bead coating, and ring coating.

After the coating process, the undercoat layer coating liquid may be heat-dried in an oven or the like, if necessary. The drying temperature of the undercoat layer is not particularly limited and may be appropriately selected depending on the type of solvent contained in the undercoat layer coating liquid, but is preferably from 80 to 200 degrees C., more preferably from 100 to 150 degrees C.

Average Thickness of Undercoat Layer

The average thickness of the undercoat layer is not particularly limited and may be appropriately selected depending on the electrical properties and lifespan of the photoconductor to be produced, but is preferably from 3 to 10 μm, more preferably from 3 to 5 μm.

When the average thickness is 3 μm or more, a charge having the opposite polarity to the charge polarity of the surface of the photoconductor does not flow from the conductive substrate into the photosensitive layer, and a defective image with background fouling caused due to defective charging does not occur. When the average thickness is 10 μm or less, defects such as a decrease in light decay function such as an increase in residual potential or a decrease in repetitive stability do not occur. The thickness of the undercoat layer may be measured with, for example, an eddy current film thickness meter, a stylus film thickness meter, a scanning electron beam microscope, or a transmission electron beam microscope. The average thickness of the undercoat layer is calculated by averaging the thickness values measured at five randomly-selected points.

Transmittance of Undercoat Layer

The method for measuring the transmittance of the undercoat layer is not particularly limited as long as it is a known measurement method. Examples thereof include, but are not limited to, ultraviolet/visible light spectroscopy.

The transmittance of the undercoat layer with respect to light having a wavelength of from 500 to 800 nm is, when the film thickness is 10 μm, 50% or more, preferably 60% or more, and the lowest transmittance value within this wavelength range is 85% or less. When the transmittance is less than 50%, background fouling is likely to occur locally. This is presumably because the dispersion state of the zinc oxide particles in the undercoat layer film is insufficient, so that aggregates thereof form leakage points. It is considered that the transmittance is lowered as a result of scattering caused by the aggregates. When the lowest transmittance value within the above-described wavelength range exceeds 85%, the zinc oxide particles are likely to be deteriorated due to fine wear, cracks, etc. As a result, electrical properties of the zinc oxide particles are deteriorated, the resistance of the undercoat layer is increased, and excellent electrical properties cannot be maintained.

Volume Resistivity of Undercoat Layer

The volume resistivity of the undercoat layer may be measured as follows. First, on the undercoat layer (having a thickness of about 10 μm) formed on the conductive substrate, a gold electrode having a diameter of 6.5 mm and a thickness of 800 angstrom is formed by vacuum deposition. The gold electrode formed at a temperature of 23 degrees C. and a relative humidity of 55% and the conductive substrate are connected to an electrometer Model 617 (product of KEITHLEY). The gold electrode and the conductive substrate are made to be a positive electrode and a negative electrode, respectively. Each of 14 levels of voltages (i.e., +10, +20, +30, +35, +40, +42, +44, +46, +48, +50, +51, +52, +53, +54 V) is applied for 2.0 seconds in the ascending order. The current value obtained from each voltage is plotted to obtain V-I characteristics. The volume resistivity of the undercoat layer is calculated from the voltage and current when an electric field of 5 V/μm is applied under the 5 levels of voltages (i.e., +50, +51, +52, +53, +54 V).

The undercoat layer used for this measurement may be either that applied to a raw tube or that obtained by peeling the laminated films (e.g., charge generation layer, charge transport layer) from the photoconductor.

The volume resistivity measured by the above-described method at a temperature of 23 degrees C. and a relative humidity of 55% is preferably $0.03\times10^6$ Ω·cm or less, more preferably from $0.003\times10^6$ to $0.01\times10^6$ Ω·cm.

When the volume resistivity exceeds $0.03\times10^6$ Ω·cm, the degree of residual image at the initial stage or after endurance is likely to deteriorate.

The proportion of the binder resin in the undercoat layer may be from 13.3% to 15.4% by mass and is preferably from 13.9% to 14.7% by mass.

Photosensitive Layer

The photosensitive layer may be either a multi-layer photosensitive layer or a single-layer photosensitive layer.

Single-Layer Photosensitive Layer

The single-layer photosensitive layer has both a charge generation function and a charge transport function.

The single-layer photosensitive layer contains a charge generation material, a charge transport material, and a binder resin, and may further contain other components, if necessary.

Charge Generation Material

The charge generation material is not particularly limited and can be suitably selected to suit to a particular application. Examples thereof include, but are not limited to, those used for the multi-layer photosensitive layer to be described later.

The content of the charge generation material is not particularly limited and can be suitably selected to suit to a particular application, but is preferably from 5 to 40 parts by mass based on 100 parts by mass of the binder resin.

Charge Transport Material

The charge transport material comprises a compound represented by the following general formula (I).

General Formula (I)

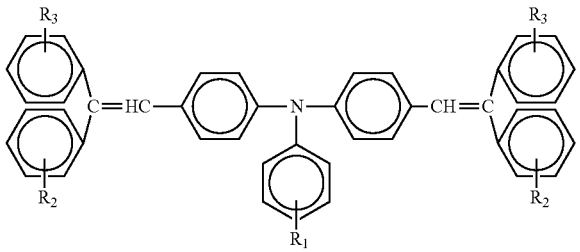

In the general formula (I), each of $R_1$ to $R_3$ independently represents a hydrogen atom, a halogen atom, an alkyl group having 1 to 6 carbon atoms which may have a substituent, or a substituted or unsubstituted aryl group having 6 to 12 carbon atoms.

Preferably, the compound represented by the general formula (I) is a compound represented by the following formula (Ia).

Formula (Ia)

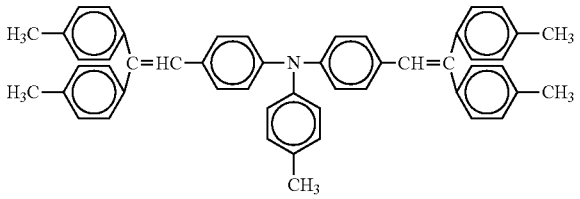

The content of the compound represented by the general formula (I) is not particularly limited and can be suitably selected to suit to a particular application, but is preferably 190 parts by mass or less, more preferably from 50 to 150 parts by mass, based on 100 parts by mass of the binder resin.

Binder Resin

The binder resin contained in the photosensitive layer is not particularly limited and can be suitably selected to suit to a particular application. Examples thereof include, but are not limited to, those used for the multi-layer photosensitive layer to be described later.

Other Components

The other components are not particularly limited and can be suitably selected to suit to a particular application.

Examples thereof include, but are not limited to, the same low-molecular charge transport materials and solvents used for the multi-layer photosensitive layer to be described later, as well as an antioxidant, a plasticizer, a lubricant, an ultraviolet absorber, and a leveling agent to be described later.

Method for Forming Single-Layer Photosensitive Layer

The method for forming the single-layer photosensitive layer is not particularly limited and can be suitably selected to suit to a particular application. The method may include the processes of dissolving or dispersing a charge generation material, a charge transport material, a binder resin, and other components in a solvent (such as tetrahydrofuran, dioxane, dichloroethane, and cyclohexane) to prepare a coating liquid, applying the coating liquid, and drying the applied coating liquid.

The method for applying the coating liquid is not particularly limited and can be suitably selected to suit to a particular application. Examples thereof include, but are not limited to, dip coating, spray coating, bead coating, and ring coating.

Additives such as a plasticizer, a leveling agent, and an antioxidant may be added to the coating liquid, if necessary.

The thickness of the single-layer photosensitive layer is not particularly limited and can be suitably selected to suit to a particular application, but is preferably from 5 to 25 μm.

The proportion of the binder resin in the single-layer photosensitive layer may be from 34.5% to 66.7% by mass and is preferably from 40.0% to 66.7% by mass.

Multi-Layer Photosensitive Layer

The multi-layer photosensitive layer has at least a charge generation layer and a charge transport layer respectively having a charge generation function and a charge transport function.

In the multi-layer photosensitive layer, the lamination order of the charge generation layer and charge transport layer is not particularly limited and can be suitably selected to suit to a particular application. Most charge generation materials have poor chemical stability and cause a decrease in charge generation efficiency in an electrophotographic image forming process when exposed to an acid gas such as a discharge product generated around a charger. Therefore, it is preferable that the charge transport layer is overlaid on the charge generation layer.

Charge Generation Layer

The charge generation layer contains a charge generation material, preferably contains a binder resin, and optionally contains other components such as an antioxidant to be describe later, if necessary.

Charge Generation Material

The charge generation material is not particularly limited and can be suitably selected to suit to a particular application. Examples thereof include, but are not limited to, inorganic materials and organic materials.

Inorganic Materials

The inorganic materials are not particularly limited and can be suitably selected to suit to a particular application. Examples thereof include, but are not limited to, crystalline selenium, amorphous-selenium, selenium-tellurium, selenium-tellurium-halogen, selenium-arsenic compounds, and amorphous-silicon (those in which dangling bonds are terminated with hydrogen atoms, halogen atoms, etc. and those containing boron atoms, phosphorus atoms, etc. are preferred).

Organic Materials

The organic materials are not particularly limited and can be suitably selected to suit to a particular application. Examples thereof include, but are not limited to, phthalocyanine pigments (e.g., metal phthalocyanine, metal-free phthalocyanine), azulenium salt pigments, squaric acid methine pigments, azo pigments having a carbazole backbone, azo pigments having a triphenylamine backbone, azo pigments having a diphenylamine backbone, azo pigments having a dibenzothiophene backbone, azo pigments having a fluorenone backbone, azo pigments having an oxadiazole backbone, azo pigments having a bisstilbene backbone, azo pigments having a distyryloxadiazole backbone, azo pigments having a distyrylcarbazole backbone, perylene pigments, anthraquinone or polycyclic quinone pigments, quinonimine pigments, diphenylmethane and triphenylmethane pigments, benzoquinone and naphthoquinone pigments, cyanine and azomethine pigments, indigoid pigments, and bisbenzimidazole pigments.

Each of these can be used alone or in combination with others.

Binder Resin

The binder resin is not particularly limited and can be suitably selected to suit to a particular application. Examples thereof include, but are not limited to, polyamide resin, polyurethane resin, epoxy resin, polyketone resin, polycarbonate resin, silicone resin, acrylic resin, polyvinyl butyral resin, polyvinyl formal resin, polyvinyl ketone resin, polystyrene resin, poly-N-vinylcarbazole resin, and polyacrylamide resin.

Each of these can be used alone or in combination with others.

Examples of the binder resin further include: charge transport polymers having a charge transport function, such as polymers (e.g., polycarbonate, polyester, polyurethane, polyether, polysiloxane, acrylic resin) having an arylamine backbone, a benzidine backbone, a hydrazone backbone, a carbazole backbone, a stilbene backbone, or a pyrazoline backbone; and polymers having a polysilane backbone.

Other Components

The other components are not particularly limited and can be suitably selected to suit to a particular application. Examples thereof include, but are not limited to, a low-molecular charge transport material and a solvent, as well as an antioxidant, a plasticizer, a lubricant, an ultraviolet absorber, and a leveling agent to be described later. The proportion of the other components in the layer to which they are added is not particularly limited and can be suitably selected to suit to a particular application, but is preferably form 0.01% to 10% by mass.

Low-Molecular Charge Transport Material

The low-molecular charge transport material is not particularly limited and can be suitably selected to suit to a particular application. Examples thereof include, but are not limited to, electron transport materials and hole transport materials. The electron transport materials are not particularly limited and can be suitably selected to suit to a particular application. Examples thereof include, but are not limited to, chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives.

Each of these can be used alone or in combination with others. The hole transport materials are not particularly limited and can be suitably selected to suit to a particular application. Examples thereof include, but are not limited to, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylm ethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, and enamine derivatives.

Each of these can be used alone or in combination with others.

Solvent

The solvent is not particularly limited and can be suitably selected to suit to a particular application. Examples thereof include, but are not limited to, tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate.

Each of these can be used alone or in combination with others.

Method for Forming Charge Generation Layer

The method for forming the charge generation layer is not particularly limited and can be suitably selected to suit to a particular application.

The method may include the processes of dissolving or dispersing the charge generation material and the binder resin in the other components such as the solvent to prepare a coating liquid, applying the coating liquid onto the conductive substrate, and drying the coating liquid applied onto the conductive substrate. The coating liquid may be applied to the conductive substrate by means of casting. The thickness of the charge generation layer is not particularly limited and can be suitably selected to suit to a particular application, but is preferably from 0.01 to 5 μm, more preferably from 0.05 to 2 μm.

Charge Transport Layer

The charge transport layer has a function of retaining charges and another function of transporting charges generated in the charge generation layer by light exposure to make them bind to the charges retained in the charge transport layer. In order to retain charges, the charge transport layer is required to have a high electrical resistance. Additionally, in order to achieve a high surface potential with the retaining charges, the charge transport layer is required to have a small dielectric constant and good charge mobility. The charge transport layer contains a charge transport material, preferably contains a binder resin, and optionally contains other components, if necessary. In the present disclosure, the material having the following structure is preferred that is effective for preventing residual image when used in combination with the undercoat layer.

Charge Transport Material

The charge transport material comprises a compound represented by the following general formula (I).

General Formula (I)

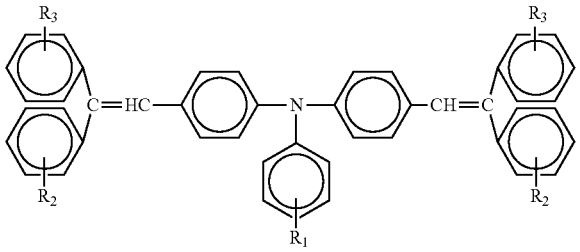

In the general formula (I), each of $R_1$ to $R_3$ independently represents a hydrogen atom, a halogen atom, an alkyl group having 1 to 6 carbon atoms which may have a substituent, or a substituted or unsubstituted aryl group having 6 to 12 carbon atoms.

Preferably, the compound represented by the general formula (I) is a compound represented by the following formula (Ia).

Formula (Ia)

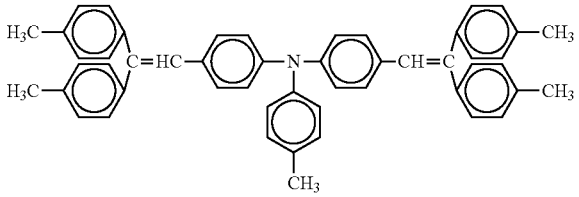

The proportion of the compound represented by the general formula (I) in the charge transport layer can be appropriately selected to suit to a particular application, but is preferably from 20% to 90% by mass, more preferably from 30% to 70% by mass. When the proportion is less than 20% by mass, the charge mobility in the charge transport layer is so small that desired light decay characteristics may not be obtained. When the proportion exceeds 90% by mass, the charge transport layer may be excessively worn by various hazards received by the photoconductor in the image forming process. When the proportion of the charge transport material in the charge transport layer is within the above-described range, an electrophotographic photoconductor with desired light decay characteristics and less wear can be obtained.

Binder Resin

The binder resin is not particularly limited and can be suitably selected to suit to a particular application. Examples thereof include, but are not limited to, polycarbonate resin, polyester resin, methacrylic resin, acrylic resin, polyethylene resin, polyvinyl chloride resin, polyvinyl acetate resin, polystyrene resin, phenol resin, epoxy resin, polyurethane resin, polyvinylidene chloride resin, alkyd resin, silicone resin, polyvinyl carbazole resin, polyvinyl butyral resin, polyvinyl formal resin, polyacrylate resin, polyacrylamide resin, and phenoxy resin.

Each of these can be used alone or in combination with others. The charge transport layer may also contain a copolymer of a cross-linkable binder resin with a cross-linkable charge transport material.

The proportion of the binder resin in the charge transport layer may be from 52.6% to 83.3% by mass and is preferably from 58.8% to 76.9% by mass.

Other Components

The other components are not particularly limited and can be suitably selected to suit to a particular application. Examples thereof include, but are not limited to, a solvent, as well as an antioxidant, a plasticizer, a lubricant, an ultraviolet absorber, and a leveling agent to be described later. The proportion of the other components in the layer to which they are added is not particularly limited and can be suitably selected to suit to a particular application, but is preferably form 0.01% to 10% by mass.

Solvent

The solvent is not particularly limited and can be suitably selected to suit to a particular application. Examples thereof include, but are not limited to, those used for the charge generation layer. Preferred examples thereof include those capable of well dissolving the charge transport material and the binder resin.

Two or more of such solvents can be used in combination.

Method for Forming Charge Transport Layer

The method for forming the charge transport layer is not particularly limited and can be suitably selected to suit to a particular application.

The method may include the processes of dissolving or dispersing the charge transport material and the binder resin in the other components such as the solvent to prepare a coating liquid, applying the coating liquid onto the charge generation layer, and heating or drying the coating liquid applied onto the charge generation layer.

The method for applying the charge transport layer coating liquid is not particularly limited and may be appropriately selected depending on the viscosity of the coating liquid, the desired thickness of the charge transport layer, etc. Examples thereof include, but are not limited to, dip coating, spray coating, bead coating, and ring coating.

In view of electrophotographic properties and film viscosity, the solvent should be removed from the charge transport layer by means of heating. The heating may be performed by, for example, applying heat energy such as the air, a gas (e.g., nitrogen gas), vapor, a heat medium, infrared rays, and electromagnetic waves from the coated surface side or the conductive substrate side.

The heating temperature is not particularly limited and can be suitably selected to suit to a particular application, but is preferably from 100 to 170 degrees C.

When the heating temperature is less than 100 degrees C., it is not possible to completely remove the solvent from the layer, causing deterioration in electrophotographic properties and wear durability.

When the heating temperature exceeds 170 degrees C., orange-peel-like defects or cracks may appear on the surface, and the layer may detach from adjacent layers. Moreover, in a case in which volatile components in the photosensitive layer are atomized to the exterior, desired electric properties may not be obtained.

The thickness of the charge transport layer is not particularly limited and can be suitably selected to suit to a particular application, but is preferably 50 μm or less, more preferably 45 μm or less, for resolution and responsiveness. Depending on the system (in particular, charge potential) in use, the lower limit of the thickness is preferably 5 μm or more.

Other Layers

The other layers are not particularly limited and can be suitably selected to suit to a particular application. Examples thereof include, but are not limited to, a protective layer, an intermediate layer, and a second undercoat layer.

Protective Layer

The protective layer (hereinafter may be referred to as "surface layer") may be provided on the photosensitive layer for the purpose of improving durability or other functions of the photoconductor.

The protective layer contains at least a binder resin and a filler, and optionally contains other components, as necessary.

Binder Resin

The binder resin is not particularly limited and can be suitably selected to suit to a particular application. Examples thereof include, but are not limited to, AS (acrylonitrile styrene) resin, ABS (acrylonitrile butadiene styrene) resin, ACS (acrylonitrile chlorinated polyethylene styrene) resin, olefin-vinyl monomer copolymer, chlorinated polyether resin, allyl resin, phenol resin, polyacetal resin, polyamide resin, polyamideimide resin, polyacrylate resin, polyarylsulfone resin, polybutylene resin, polybutylene terephthalate resin, polycarbonate resin, polyethersulfone resin, polyethyne resin, polyethylene terephthalate resin, polyimide resin, acrylic resin, polymethylpentene resin, polypropylene resin, polyphenylene oxide resin, polysulfone resin, polyurethane resin, polyvinyl chloride resin, polyvinylidene chloride resin, and epoxy resin.

Each of these may be used alone or in combination with others.

Among these, polycarbonate resin and polyacrylate resin are preferred in view of filler dispersibility, residual potential, and coated film defect.

Filler

The filler is not particularly limited and can be suitably selected to suit to a particular application. Examples thereof include, but are not limited to, metal oxide particles.

The metal oxide particles are not particularly limited and can be suitably selected to suit to a particular application. Examples thereof include, but are not limited to, aluminum oxide, zinc oxide, titanium oxide, tin oxide, antimony oxide, indium oxide, bismuth oxide, tin-containing indium oxide, antimony- or tantalum-containing tin oxide, and antimony-containing zirconium oxide.

Each of these may be used alone or in combination with others.

The method for forming the protective layer is not particularly limited and can be formed with appropriately-selected solvent and coating method as in forming the above-described photosensitive layer. Examples thereof include, but are not limited to, dip coating, spray coating, bead coating, nozzle coating, spinner coating, and ring coating.

The solvent used for forming the protective layer is not particularly limited and can be suitably selected to suit to a particular application. Examples thereof include, but are not limited to, tetrahydrofuran, dioxane, toluene, dichloromethane, monochlorobenzene, dichloroethane, cyclohexanone, methyl ethyl ketone, and acetone.

Preferred examples of the solvent include those exhibit high viscosity at the time of dispersing the binder resin or filler and high volatility at the time of coating.

If no solvent satisfies the above preferences, two or more types of solvents having different properties can be used in combination, which may have a great effect on filler dispersibility and residual potential.

It is effective to add the charge transport material used for the charge transport layer to the protective layer for reducing residual potential and improving image quality.

The thickness of the protective layer is not particularly limited and can be suitably selected to suit to a particular application, but is preferably from 1 to 5 μm for wear resistance.

Intermediate Layer

In the case of providing a surface layer on the surface of the photosensitive layer, the intermediate layer may be provided between the charge transport layer and the surface layer for the purpose of preventing the charge transport layer components from coming into the surface layer or improving the adhesiveness between these two layers. The intermediate layer contains at least a binder resin, and optionally contains other components such as an antioxidant, if necessary.

Preferably, the intermediate layer is insoluble or poorly-soluble in the surface layer coating liquid.

The binder resin contained in the intermediate layer is not particularly limited and can be suitably selected to suit to a particular application. Examples thereof include, but are not limited to, polyamide, alcohol-soluble nylon, polyvinyl butyral, and polyvinyl alcohol.

The method for forming the intermediate layer is not particularly limited and can be suitably selected to suit to a particular application. The intermediate layer may be formed with appropriately-selected solvent and coating method as in forming the above-described photosensitive layer.

The thickness of the intermediate layer is not particularly limited and can be suitably selected to suit to a particular application, but is preferably from 0.05 to 2 μm.

Second Undercoat Layer

The photoconductor may include a second undercoat layer between the conductive substrate and the undercoat layer or between the undercoat layer and the photosensitive layer. The second undercoat layer contains a binder resin, and optionally contains other components, as necessary.

The binder resin is not particularly limited and can be suitably selected to suit to a particular application. Examples thereof include, but are not limited to, polyamide, alcohol-soluble nylon, water-soluble polyvinyl butyral, polyvinyl butyral, and polyvinyl alcohol.

The method for forming the second undercoat layer is not particularly limited. The second undercoat layer can be formed with appropriately-selected solvent and coating method.

The thickness of the second undercoat layer is not particularly limited and can be suitably selected to suit to a particular application, but is preferably from 0.05 to 2 μm.

For improving environmental resistance of the photoconductor, particularly for preventing a decrease in sensitivity and an increase in residual potential, each of the charge generation layer, charge transport layer, undercoat layer, protective layer, and second undercoat layer may contain an antioxidant, a plasticizer, a lubricant, an ultraviolet absorber, and/or a leveling agent.

The antioxidant is not particularly limited and can be suitably selected to suit to a particular application. Examples thereof include, but are not limited to, phenolic compounds, paraphenylenediamines, hydroquinones, organic sulfur compounds, and organic phosphorus compounds.

Each of these may be used alone or in combination with others.

The plasticizer is not particularly limited and can be suitably selected to suit to a particular application. Examples thereof include, but are not limited to, plasticizers for general resins, such as dibutyl phthalate and dioctyl phthalate.

The lubricant is not particularly limited and can be suitably selected to suit to a particular application. Examples thereof include, but are not limited to, hydrocarbon compounds, fatty acid compounds, fatty acid amide compounds, ester compounds, alcohol compounds, metal soaps, and natural waxes.

Each of these may be used alone or in combination with others.

The ultraviolet absorber is not particularly limited and can be suitably selected to suit to a particular application. Examples thereof include, but are not limited to, benzophenone ultraviolet absorbers, salicylate ultraviolet absorbers, benzotriazole ultraviolet absorbers, cyanoacrylate ultraviolet absorbers, quenchers (metal complex salt ultraviolet absorbers), and HALS (hindered amine light stabilizers).

Each of these may be used alone or in combination with others.

The leveling agent is not particularly limited and can be suitably selected to suit to a particular application. Examples thereof include, but are not limited to, silicone oils such as dimethyl silicone oil and methyl phenyl silicone oil, and polymers and oligomers having a perfluoroalkyl group on a side chain.

Each of these can be used alone or in combination with others.

Conductive Substrate

The conductive substrate is not particularly limited and can be suitably selected to suit to a particular application as long as it has a volume resistivity of $1\times10^{10}$ Ω·cm or less.

An endless belt (e.g., endless nickel belt, endless stainless-steel belt) disclosed in Examined Japanese Patent Publication No. 52-36016 may also be used.

The method for forming the conductive substrate is not particularly limited and can be suitably selected to suit to a particular application.

The method may include the processes of coating a substrate (e.g., plastic film, plastic cylinder, paper sheet) with a metal (e.g., aluminum, nickel, chromium, nichrome, copper, gold, silver, platinum) or a metal oxide (e.g., tin oxide, indium oxide) by vapor deposition or sputtering.

Alternatively, the method may include the processes of extruding or drawing a plate of a metal (e.g., aluminum, aluminum alloy, nickel, stainless steel) to form a raw tube and surface-treating (e.g., cutting, superfinishing, polishing) the raw tube.

The conductive substrate may be provided with a conductive layer on the substrate.

The method for forming the conductive layer is not particularly limited and can be suitably selected to suit to a particular application. The method may include the processes of applying a coating liquid containing a conductive powder and a binder resin, which may be dispersed or dissolved in a solvent, as necessary, onto the conductive substrate. Alternatively, the conductive layer may be formed with a heat-shrinkable tube made of a material, such as polyvinyl chloride, polypropylene, polyester, polystyrene, polyvinylidene chloride, polyethylene, chlorinated rubber, or TEFLON (registered trademark), in which the conductive powder is contained.

The conductive powder is not particularly limited and can be suitably selected to suit to a particular application. Examples thereof include, but are not limited to, carbon particles such as carbon black and acetylene black; powders of metals such as aluminum, nickel, iron, nichrome, copper, zinc, and silver; and powders of metal oxides such as conductive tin oxide and ITO.

The binder resin in the conductive layer is not particularly limited and can be suitably selected to suit to a particular application. Examples thereof include, but are not limited to, thermoplastic, thermosetting, and photo-curable resins, such as polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyarylate resin, phenoxy resin, polycarbonate resin, cellulose acetate resin, ethyl cellulose resin, polyvinyl butyral resin, polyvinyl formal resin, polyvinyl toluene resin, poly-N-vinylcarbazole, acrylic resin, silicone resin, epoxy resin, melamine resin, urethane resin, phenol resin, and alkyd resin.

The solvent used for forming the conductive layer is not particularly limited and can be suitably selected to suit to a particular application. Examples thereof include, but are not limited to, tetrahydrofuran, dichloromethane, methyl ethyl ketone, and toluene.

Embodiments of Photoconductor

Hereinafter, the photoconductors according to some embodiments of the present invention are described.

First Embodiment

The layer structure of a photoconductor according to a first embodiment is described below with reference to FIG. 1. FIG. 1 is a schematic diagram illustrating the layer structure of a photoconductor having a single-layer photosensitive layer. This photoconductor includes, from the innermost side thereof, a conductive substrate 31, an undercoat layer 32, and a single-layer photosensitive layer 33.

Second Embodiment

Figure 2:
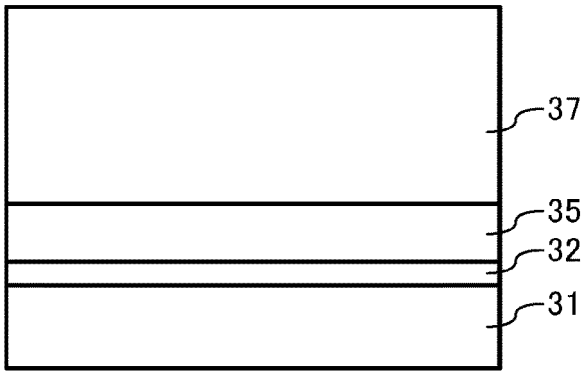
FIG. 2 is a schematic diagram for explaining the layer structure of another photoconductor according to an embodiment of the present invention.

The layer structure of a photoconductor according to a second embodiment is described below with reference to FIG. 2. FIG. 2 is a schematic diagram illustrating the layer structure of a photoconductor having a multi-layer photosensitive layer. This photoconductor includes, from the innermost side thereof, a conductive substrate 31, an undercoat layer 32, a charge generation layer 35, and a charge transport layer 37. The charge generation layer 35 and the charge transport layer 37 correspond to the photosensitive layer.

Third Embodiment

Figure 3:
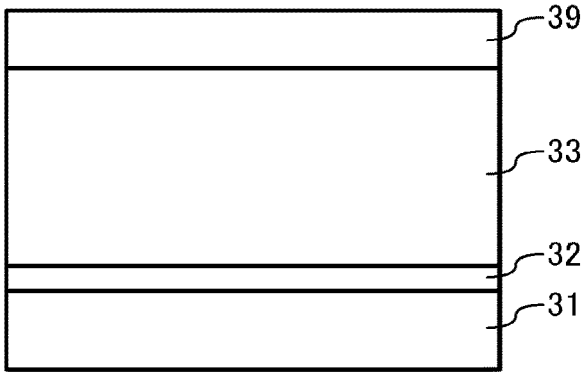
FIG. 3 is a schematic diagram for explaining the layer structure of another photoconductor according to an embodiment of the present invention.

The layer structure of a photoconductor according to a third embodiment is described below with reference to FIG. 3. FIG. 3 is a schematic diagram illustrating the layer structure of a photoconductor having a single-layer photosensitive layer. This photoconductor includes, from the innermost side thereof, a conductive substrate 31, an undercoat layer 32, a photosensitive layer 33, and a protective layer 39.

Fourth Embodiment

Figure 4:
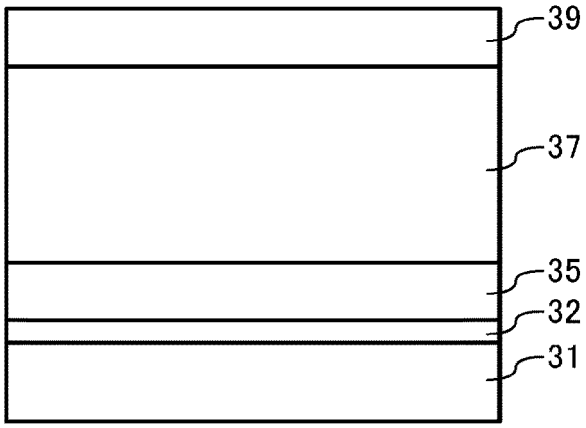
FIG. 4 is a schematic diagram for explaining the layer structure of another photoconductor according to an embodiment of the present invention.

The layer structure of a photoconductor according to a fourth embodiment is described below with reference to FIG. 4. FIG. 4 is a schematic diagram illustrating the layer structure of a photoconductor having a multi-layer photosensitive layer. This photoconductor includes, from the innermost side thereof, a conductive substrate 31, an undercoat layer 32, a charge generation layer 35, a charge transport layer 37, and a protective layer 39. The charge generation layer 35 and the charge transport layer 37 correspond to the photosensitive layer.

Image Forming Apparatus

An image forming apparatus according to an embodiment of the present invention includes: a photoconductor; a charger configured to charge a surface of the photoconductor; an irradiator configured to irradiate the charged surface of the photoconductor with light to form an electrostatic latent image; a developing device containing a toner, configured to develop the electrostatic latent image with the toner to form a visible image; and a transfer device configured to transfer the visible image onto a recording medium. The image forming apparatus may further include other devices, as necessary. The photoconductor used in the image forming apparatus is the above-described photoconductor according to an embodiment of the present invention. The charger and the irradiator may be collectively referred to as an "electrostatic latent image forming device".

Embodiments of Image Forming Apparatus

Hereinafter, an image forming apparatus according to an embodiment of the present invention is described.

Figure 5:
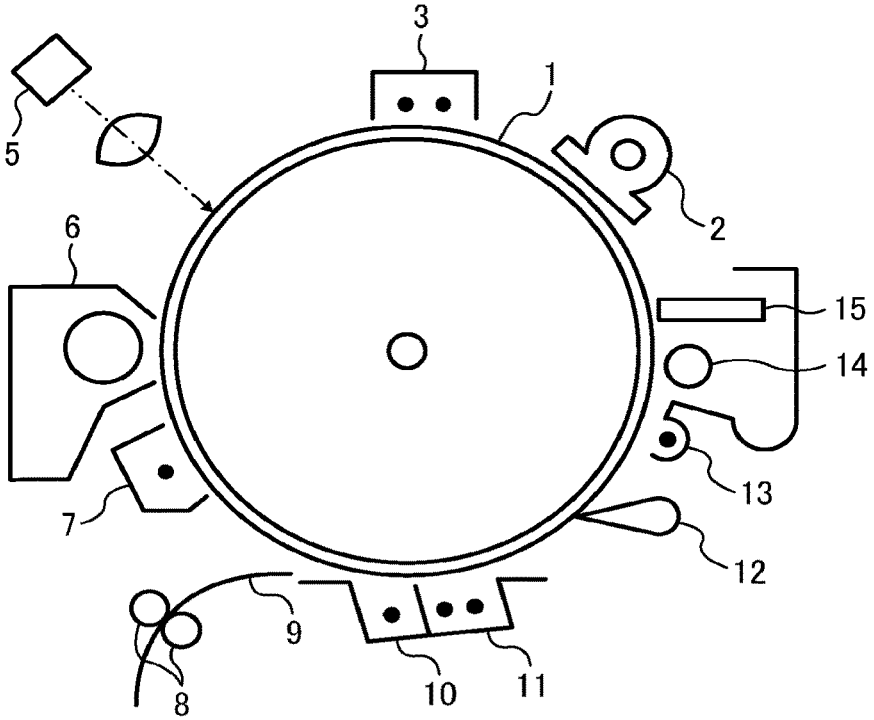
FIG. 5 is a schematic diagram illustrating an image forming apparatus according to an embodiment of the present invention.

FIG. 5 is a schematic diagram illustrating an image forming apparatus according an embodiment of the present invention. This image forming apparatus includes a photoconductor 1; and a charger 3, an irradiator 5, a developing device 6, and a transfer device 10 disposed around the photoconductor 1.

First, the charger 3 uniformly charges the photoconductor 1. Specific examples of the charger 3 include, but are not limited to, a corotron device, a scorotron device, a solid-state discharging element, a multi-stylus electrode, a roller charging device, and a conductive brush device.

Next, the irradiator 5 forms an electrostatic latent image on the uniformly-charged photoconductor 1. The irradiator 5 includes a light source. Examples of the light source include all luminous matters such as fluorescent lamp, tungsten lamp, halogen lamp, mercury lamp, sodium-vapor lamp, light-emitting diode (LED), laser diode (LD), and electroluminescence (EL). For the purpose of emitting only light having a desired wavelength, any type of filter can be used, such as sharp cut filter, band pass filter, near infrared cut filter, dichroic filter, interference filter, and color-temperature conversion filter.

Next, the developing device 6 develops the electrostatic latent image formed on the photoconductor 1 into a visible image. The developing method may be either a dry developing method using a dry toner, such as one-component developing method and two-component developing method; or a wet developing method using a wet toner.

As the photoconductor 1 is positively (negatively) charged and irradiated with light containing image information, a positive (negative) electrostatic latent image is formed on the surface of the photoconductor 1.

When the positive (negative) electrostatic latent image is developed with a negative (positive) polarity toner, a positive image is produced. By contrast, when the positive (negative) electrostatic latent image is developed with a positive (negative) polarity toner, a negative image is produced.

Next, the transfer device 10 transfers the visible image formed on the photoconductor 1 onto a recording medium 9 that has been fed by a pair of rollers 8. For improving transfer efficiency, a pre-transfer charger 7 may also be used. The transfer device 10 may employ any transfer method, such as an electrostatic transfer method using a transfer charger or a bias roller; a mechanical transfer method such as an adhesive transfer method and a pressure transfer method; or a magnetic transfer method.

As means for separating the recording medium 9 from the photoconductor 1, a separation charger 11 and a separation claw 12 may be used, if necessary. The separation may also be performed by means of electrostatic adsorption induction separation, side-end belt separation, leading-end grip conveyance, or curvature separation. As the separation charger 11, the above-described charger may be used. After image transfer, cleaners such as a fur brush 14 and a cleaning blade 15 remove residual toner particles remaining on the photoconductor 1. For improving cleaning efficiency, a pre-cleaning charger 13 may also be used. The cleaning may also be performed by a web-type cleaner, a magnetic-brush-type cleaner, etc. Such cleaners can be used alone or in combination. For removing residual latent image on the photoconductor 1, a neutralizer 2 may be used. Specific examples of the neutralizer 2 include, but are not limited to, a neutralization lamp and a neutralization charger. As the neutralization lamp and the neutralization charger, the above-described light source and charger can be used, respectively.

Processes that are performed away from the photoconductor 1, such as document reading, sheet feeding, fixing, sheet ejection, can be performed by known devices.

Process Cartridge

A process cartridge according to an embodiment of the present invention includes: a photoconductor; and at least one member selected from: a charger configured to charge a surface of the photoconductor; an irradiator configured to irradiate the charged surface of the photoconductor with light to form an electrostatic latent image; a developing device containing a toner, configured to develop the electrostatic latent image with the toner to form a visible image; and a transfer device configured to transfer the visible image onto a recording medium. The process cartridge may further include other devices, as necessary.

The photoconductor used in the process cartridge is the above-described photoconductor according to an embodiment of the present invention.

Figure 6:
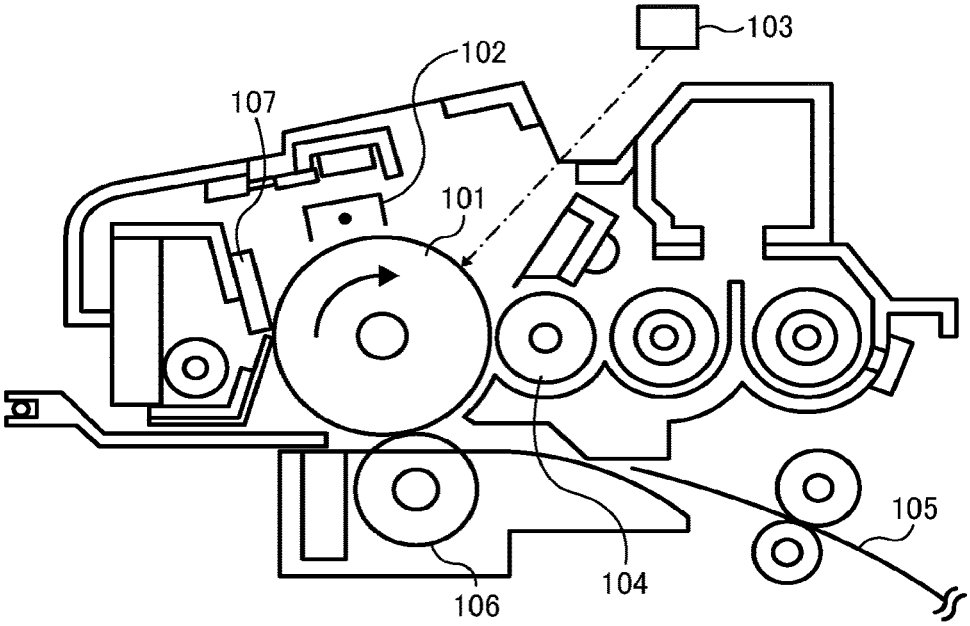
FIG. 6 is a schematic diagram illustrating a process cartridge according to an embodiment of the present invention.

As illustrated in FIG. 6, the process cartridge includes at least one of a photoconductor 101, a charger 102, a developing device 104, a transfer device 106, a cleaner 107, and a neutralizer. The process cartridge is a device (part) that is detachably mountable on an image forming apparatus body. In the image forming process of the process cartridge, a surface of the photoconductor 101 is charged by the charger 102 and irradiated with light emitted from an irradiator 103 while the photoconductor 101 rotates in a direction indicated by arrow in FIG. 6. As a result, an electrostatic latent image is formed on the surface of the photoconductor 101. The electrostatic latent image is developed into a toner image by the developing device 104. The toner image is transferred onto a recording medium 105 by the transfer device 106. The recording medium 105 having the toner image thereon is printed out. After the toner image has been transferred, the cleaner 107 cleans the surface of the photoconductor 101 and the neutralizer neutralizes the surface of the photoconductor 101. These operations are repeatedly performed.

EXAMPLES

Further understanding can be obtained by reference to certain specific examples which are provided herein for the purpose of illustration only and are not intended to be limiting. In the following descriptions, "parts" represent "parts by mass".

The zinc oxide particles used in the following Example were those surface-treated with an alkyl alkoxysilane having an alkyl group having 4 or less carbon atoms.

Preparation of Undercoat Layer Coating Liquid

Preparation Example 1-1

Preparation of Surface-Treated Zinc Oxide 1-1

Zinc oxide particles having an average primary particle diameter of 50 nm prepared by the above-described wet method were surface-treated in the following manner.

First, the below-listed materials were subjected to a dispersion treatment by being stirred for 2.5 hours. Next, toluene was removed by distillation under reduced pressures, and baking was performed at 120 degrees C. for 3 hours. Thus, surface-treated zinc oxide particles 1-1 were prepared.

Zinc oxide particles: 200 parts

Surface treatment agent (Methyltrimethoxysilane, Z-6366 manufactured by Dow Corning Toray Co., Ltd.): 6 parts Solvent (Toluene): 1000 parts Preparation of Undercoat Layer Coating Liquid 1-1

The below-listed materials were mixed and dispersed using a vibration mill filled with zirconia beads having a diameter of 0.6 mm for 2.5 hours, thus preparing an undercoat layer coating liquid 1-1.

Surface-treated zinc oxide particles 1-1: 100 parts

Binder resin (Alkyd-melamine resin): 33.3 parts (Alkyd resin: BECKOLITE (having a solid content concentration of about 50%), Melamine resin: AMDIR (having a solid content concentration of about 60%), each manufactured by DIC Corporation)

Solvent (2-Butanone): 120 parts

Zinc oxide particles/Binder resin=F/R=6/1 (in mass ratio)

Preparation of Undercoat Layer Coating Liquids 1-2 and 1-3

Undercoat layer coating liquids 1-2 and 1-3 were prepared in the same manner as the undercoat layer coating liquid 1-1 except for changing the dispersion treatment time from 2.5 hours to 2.0 hours and 1.5 hours, respectively.

Preparation of Undercoat Layer Coating Liquids 1-4 to 1-6

Undercoat layer coating liquids 1-4, 1-5, and 1-6 were prepared in the same manner as the undercoat layer coating liquid 1-1 except for changing the mass ratio of the zinc oxide particles to the binder resin from 6/1 to 4/1, 5/1, and 7/1, respectively, with the dispersion treatment time kept at 2.5 hours.

Preparation of Undercoat Layer Coating Liquid 1-7

An undercoat layer coating liquid 1-7 was prepared in the same manner as the undercoat layer coating liquid 1-1 except for replacing the zinc oxide particles with titanium oxide particles having an average primary particle diameter of 50 nm, replacing the resin with a nylon resin, changing the components and blending amounts of the binder resin as shown in Table 1, and changing the dispersion treatment time to 10.0 hours.

Preparation of Undercoat Layer Coating Liquid 1-8

An undercoat layer coating liquid 1-8 was prepared in the same manner as the undercoat layer coating liquid 1-1 except for changing the components and blending amounts of the binder resin as shown in Table 1 and changing the dispersion treatment time to 10.0 hours.

TABLE 1

| Undercoat Layer Coating Liquid | Particles Contained in Undercoat Layer | Binder Resin | F/R *2 | Dispersion Treatment Time |
|---|---|---|---|---|
| 1-1 | Surface-treated Zinc Oxide Particles | Alkyd Melamine | 6/1 | 2.5 Hr |
| 1-2 | Surface-treated Zinc Oxide Particles | Alkyd Melamine | 6/1 | 2.0 Hr |
| 1-3 | Surface-treated Zinc Oxide Particles | Alkyd Melamine | 6/1 | 1.5 Hr |
| 1-4 | Surface-treated Zinc Oxide Particles | Alkyd Melamine | 4/1 | 2.5 Hr |
| 1-5 | Surface-treated Zinc Oxide Particles | Alkyd Melamine | 5/1 | 2.5 Hr |
| 1-6 | Surface-treated Zinc Oxide Particles | Alkyd Melamine | 7/1 | 2.5 Hr |

TABLE 1-continued

| Undercoat Layer Coating Liquid | Particles Contained in Undercoat Layer | Binder Resin | F/R *2 | Dispersion Treatment Time |
|---|---|---|---|---|
| 1-7 | Titanium Oxide Particles | Nylon Resin *1 | 3/1 | 10 Hr |
| 1-8 | Surface-treated Zinc Oxide Particles | Nylon Resin *1 | 3/1 | 10 Hr |

*1) Nylon Resin (AMILAN CM-8000 manufactured by Toray Industries, Inc.)

*2) F/R = Particles Contained in Undercoat Layer (Zinc Oxide Particles or Titanium Oxide)/Binder Resin (in mass ratio)

Preparation of Charge Generation Layer Coating Liquid

A charge generation layer coating liquid was prepared in the following manner.

The below-listed materials were mixed and stirred using a bead mill filled glass beads having a diameter of 1 mm for 8 hours, thus preparing a charge generation layer coating liquid.

Charge generation material (Titanyl phthalocyanine): 8 parts

Figure 7:
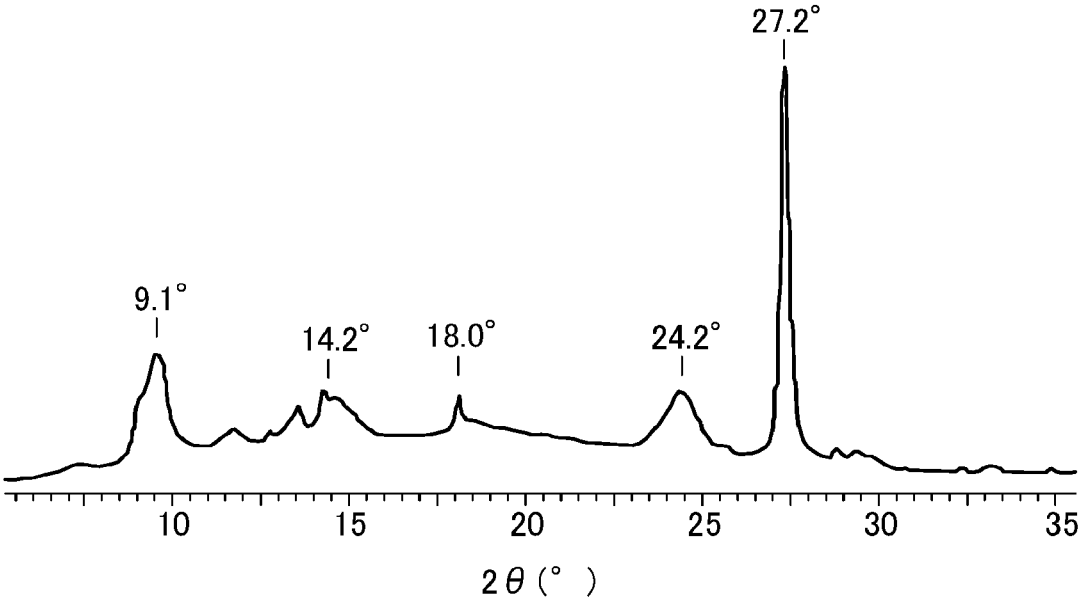
FIG. 7 is a powder X-ray diffraction spectrum of titanyl phthalocyanine used in Examples.

Binder resin (Polyvinyl butyral, S-LEC BX-1 manufactured by Sekisui Chemical Co., Ltd.): 5 parts Solvent (2-Butanone): 400 parts A powder X-ray diffraction spectrum of the titanyl phthalocyanine is shown in FIG. 7.

Preparation of Charge Transport Layer Coating Liquid

A charge transport layer coating liquid was prepared in the following manner.

The below-listed materials were mixed and stirred until all the materials were dissolved, thus preparing a charge transport layer coating liquid.

Charge transport material represented by the following formula (Ia): 6 parts

Binder resin (Polycarbonate, TS-2050 manufactured by Teijin Chemicals Ltd.): 10 parts Solvent (Tetrahydrofuran): 100 parts Formula (Ia)

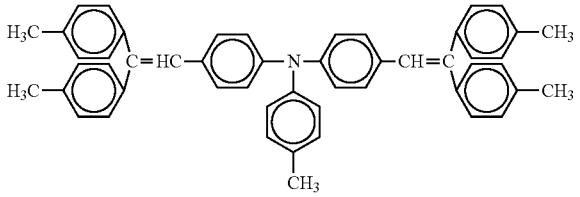

Example 1-1

An aluminum cylinder (having a diameter of 100 mm and a length of 380 mm) was coated with the undercoat layer coating liquid 1-1 by dip coating and dried at 130 degrees C. for 20 minutes, thus forming an undercoat layer having an average thickness of 3.5 μm. Next, the aluminum cylinder was further coated with the charge generation layer coating liquid by dip coating, thus forming a charge generation layer having an average thickness of 0.2 μm. Next, the aluminum cylinder was further coated with the charge transport layer coating liquid by dip coating and dried at 135 degrees C. for 20 minutes, thus forming a charge transport layer having an average thickness of 30 μm. Thus, a photoconductor 1-1 of Example 1-1 was prepared.

Example 1-2 and Example 1-3

In Examples 1-2 and 1-3, the procedure in Example 1-1 was repeated except for replacing the undercoat layer coating liquid 1-1 with the respective undercoat layer coating liquids 1-2 and 1-3, thus preparing photoconductors 1-2 and 1-3, respectively.

Comparative Example 1-1

In Comparative Example 1-1, the procedure in Example 1-1 was repeated except for replacing the undercoat layer coating liquid 1-1 with the undercoat layer coating liquid 1-7 and changing the average thickness of the undercoat layer to 1.5 μm, thus preparing a photoconductor 1-4.

Comparative Example 1-2

In Comparative Example 1-2, the procedure in Example 1-1 was repeated except for replacing the undercoat layer coating liquid 1-1 with the undercoat layer coating liquid 1-7, thus preparing a photoconductor 1-5.

Comparative Example 2-1

In Comparative Example 2-1, the procedure in Example 1-1 was repeated except for replacing the undercoat layer coating liquid 1-1 with the undercoat layer coating liquid 1-8, thus preparing a photoconductor 1-6.

Comparative Examples 3-1 to 3-6

In Comparative Examples 3-1 to 3-6, the procedure in Example 1-1 was repeated except for replacing the undercoat layer coating liquid 1-1 with the respective undercoat layer coating liquids 1-1 to 1-6 and changing the charge transport material to a compound having the following structural formula, thus preparing photoconductors 1-7 to 1-12, respectively.

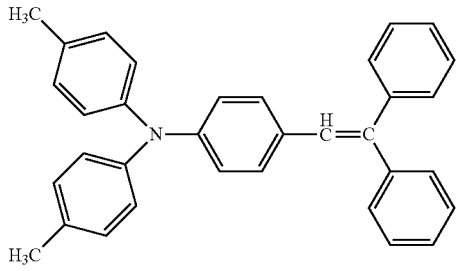

The type of the undercoat layer coating liquid and the film thickness of the undercoat layers in Examples and Comparative Examples are shown in Table 2.

The evaluation results of the film thickness of the undercoat layer, the transmittance of the undercoat layer, and the volume resistivity are also shown in Table 2.

The film thickness of the undercoat layer, the transmittance of the undercoat layer, and the volume resistivity were measured as follows.

Measurement of Film Thickness of Undercoat Layer

The film thickness of the undercoat layer was measured with an eddy current film thickness meter (FISCHERSCOPE MMS) manufactured by FISCHER INSTRUMENTS K.K. The average thickness of the undercoat layer was calculated by averaging the thickness values measured at five randomly-selected points.

Transmittance of Undercoat Layer

An undercoat layer having a film thickness of 10 μm was formed on a glass plate with each undercoat layer coating liquid of each Example or Comparative Example under the same coating conditions as in Example 1-1.

The transmittance of the above-formed undercoat layer in a wavelength range of from 500 to 800 nm was measured using an ultraviolet-visible-near-infrared spectrophotometer UV-3600 (manufactured by Shimadzu Corporation).

The lowest transmittance value within the above-described wavelength range is shown in Table 2.

Volume Resistivity of Undercoat Layer

An undercoat layer having a film thickness of 10 μm was formed on a conductive substrate with each undercoat layer coating liquid of each Example or Comparative Example under the same coating conditions as in Example 1-1.

On the undercoat layer, a gold electrode having a diameter of 6.5 mm and a thickness of 800 angstrom was formed by vacuum deposition. The gold electrode formed at a temperature of 23 degrees C. and a relative humidity of 55% and the conductive substrate were connected to an electrometer Model 617 (product of KEITHLEY) so that the gold electrode and the conductive substrate were made to be a positive electrode and a negative electrode, respectively. The volume resistivity of the undercoat layer was calculated from the voltage and current when an electric field of 5 V/μm was applied.

The volume resistivity of the undercoat layer in each Example or Comparative Example is shown in Table 2.

Photoconductor Properties

The photoconductors obtained in Examples and Comparative Examples were evaluated in terms of image (residual image).

The evaluation results are shown in Table 2.

The evaluation was performed as follows.

Evaluation Apparatus

A digital copier (PRO C900 manufactured by Ricoh Co., Ltd.) that had been modified to include a scorotron charger (equipped with a discharge wire made of gold-plated tungsten-molybdenum alloy having a diameter of 50 μm), an irradiator (equipped with a light source that emits laser light having a wavelength of 780 nm and a polygon mirror for writing images at a resolution of 1,200 dpi), a two-component develop containing black toner, a transfer belt, and a neutralization lamp, was used as an evaluation apparatus.

Method for Deteriorating Photoconductor

An endurance test was performed in which a black single-color test chart was continuously output on 20 KP (i.e., 20,000) sheets under a normal-temperature normal-humidity condition (MM) in which the temperature was 23 degrees C. and the relative humidity was 55%.

Image Evaluation

An image was output before and after the deterioration of the photoconductor, and the output image was evaluated in terms of residual image.

Image Pattern for Evaluating Residual Image

Figure 8:
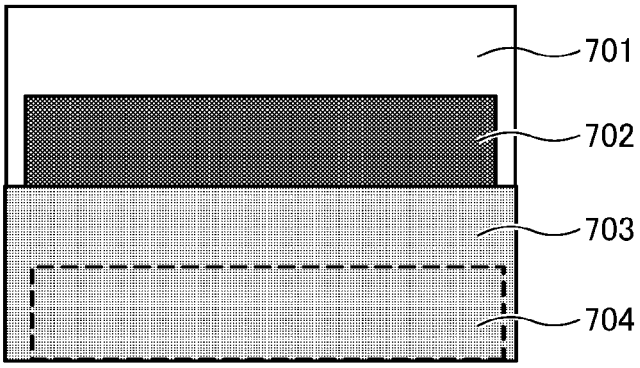
FIG. 8 is a diagram for explaining an image pattern for evaluating residual image in Examples.

An image pattern for evaluating residual image, illustrated in FIG. 8, was prepared.

Referring to FIG. 8, the image pattern includes a white portion 701, a black solid portion 702, a halftone portion 703, and a portion 704 where a residual image resulting from the black solid portion 702 appears.

Method for Evaluating Residual Image

The degree of residual image was evaluated by sensory evaluation according to the following criteria.

Evaluation Criteria

The degree of residual image was quantitatively ranked into 1 to 5 levels.

(Target residual image rank was 4.0 or higher.)

On the first image (initial rank 0 KP) after 100 sheets of continuous output, the 1,000th image (10 KP after the endurance test), and the 2,000th image (20 KP after the endurance test), a residual image appeared in the portion 704 in FIG. 8 was visually observed and evaluated.

Rank 5: No residual image is observed.

Rank 4: A very slight residual image is observed. (Within image quality standards)

Rank 3: A slight residual image is observed. (Out of image quality standards)

Rank 2 or lower: A clear residual image is observed. (Out of image quality standards)

The part after the decimal point indicates an intermediate evaluation between the ranks. For example, rank "4.5" indicates an intermediate evaluation between rank 4 and rank 5.

The results are shown in Table 2.

TABLE 2

| Photoconductor No. | Examples and Comparative Examples | Undercoat Layer Coating Liquid | Volume Resistivity of Undercoat Layer ($\times 10^6\ \Omega \cdot cm$) | Lowest Transmittance (%) | Particles | Binder Resin |
|---|---|---|---|---|---|---|
| 1-1 | Example 1-1 | 1-1 | 0.03 | 82.5 | Zinc Oxide Particles | Alkyd Melamine |
| 1-2 | Example 1-2 | 1-2 | 0.014 | 81.3 | Zinc Oxide Particles | Alkyd Melamine |
| 1-3 | Example 1-3 | 1-3 | 0.0036 | 80.8 | Zinc Oxide Particles | Alkyd Melamine |
| 1-4 | Comparative Example 1-1 | 1-7 | — | 84.9 | Titanium Oxide Particles | Nylon |
| 1-5 | Comparative Example 1-2 | 1-7 | — | 84.9 | Titanium Oxide Particles | Nylon |
| 1-6 | Comparative Example 2-1 | 1-8 | — | — | Zinc Oxide Particles | Nylon |
| 1-7 | Comparative example 3-1 | 1-4 * | 1.45 | 83.3 | Zinc Oxide Particles | Alkyd Melamine |
| 1-8 | Comparative example 3-2 | 1-5 * | 0.26 | 83.1 | Zinc Oxide Particles | Alkyd Melamine |
| 1-9 | Comparative Example 3-3 | 1-1 * | 0.03 | 82.5 | Zinc Oxide Particles | Alkyd Melamine |

TABLE 2-continued

| | | | | | | |
|---|---|---|---|---|---|---|
| 1-10 | Comparative Example 3-4 | 1-2 * | 0.014 | 81.3 | Zinc Oxide Particles | Alkyd Melamine |
| 1-11 | Comparative Example 3-5 | 1-3 * | 0.0036 | 80.8 | Zinc Oxide Particles | Alkyd Melamine |
| 1-12 | Comparative Example 3-6 | 1-6 * | — | 35.5 | Zinc Oxide Particles | Alkyd Melamine |

| Photoconductor | Film Thickness | | Residual Image: Initial Rank | Residual Image: After Endurance | | |
|---|---|---|---|---|---|---|
| No. | (μm) | F/R | 0 KP | 10 KP | 20 KP | Remarks |
| 1-1 | 3.5 | 6/1 | 5.0 | 4.5 | 4.0 | |
| 1-2 | 3.5 | 6/1 | 5.0 | 5.0 | 4.5 | |
| 1-3 | 3.5 | 6/1 | 5.0 | 5.0 | 4.5 | |
| 1-4 | 1.5 | 3/1 | 1.5 | 1.0 | 1.0 | Unable to evaluate volume resistivity due to the use of titanium oxide particles. |
| 1-5 | 3.5 | 3/1 | 1.5 | 1.0 | 1.0 | Unable to evaluate volume resistivity due to the use of titanium oxide particles. |
| 1-6 | 3.5 | 3/1 | — | — | — | Unable to evaluate due to poor dispersion. |
| 1-7 | 3.5 | 4/1 | 1.5 | 1.0 | 1.0 | |
| 1-8 | 3.5 | 5/1 | 2.5 | 1.5 | 1.0 | |
| 1-9 | 3.5 | 6/1 | 4.0 | 3.5 | 2.5 | |
| 1-10 | 3.5 | 6/1 | 4.0 | 4.0 | 3.0 | |
| 1-11 | 3.5 | 6/1 | 5.0 | 4.5 | 3.5 | |
| 1-12 | 3.5 | 7/1 | — | — | — | Unable to evaluate due to poor dispersion. |

* The charge transport material contained in the coating liquids used in Comparative Examples 3-1 to 3-6 were out of scope of the present invention. Also, the F/R was changed.

It is clear from the results shown in Table 2 that the photoconductor prepared in each Example was prevented from forming residual image during image formation even when used for a long period of time because the volume resistivity of the undercoat layer was set in a specific range and the charge transport material having a specific structure was contained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An electrophotographic photoconductor comprising:

a conductive substrate;

an undercoat layer overlying the conductive substrate, the undercoat layer containing zinc oxide particles and a binder resin and having a volume resistivity of $0.03\times 10^6$ Ω·cm or less in an electrical field of 5 V/μm at a temperature of 23 degrees C. and a relative humidity of 55%; and a photosensitive layer overlying the undercoat layer, the photosensitive layer containing a compound represented by the following general formula (I):

General Formula (I)

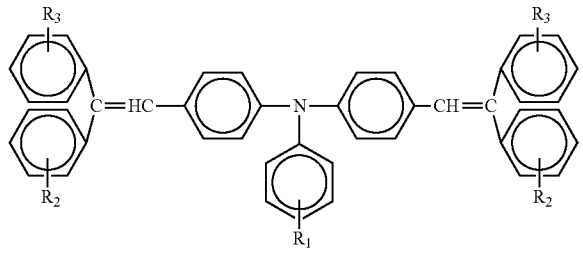

where each of $R_1$ to $R_3$ independently represents a hydrogen atom, a halogen atom, an alkyl group having 1 to 6 carbon atoms which may have a substituent, or a substituted or unsubstituted aryl group having 6 to 12 carbon atoms.

2. The electrophotographic photoconductor according to claim 1, wherein the compound represented by the formula (I) is a compound represented by the following formula (Ia).

Formula (Ia)

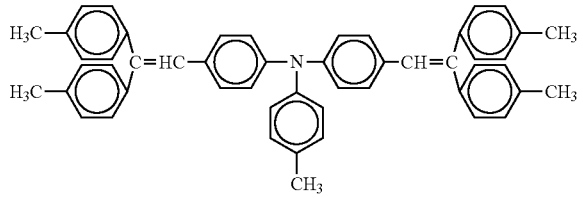

3. The electrophotographic photoconductor according to claim 1, wherein the binder resin comprises an alkyd melamine resin.

4. The electrophotographic photoconductor according to claim 3, wherein a mass ratio of the zinc oxide particles to the alkyd melamine resin is from 84.6/15.4 to 86.7/13.3.

5. An image forming apparatus comprising:

the electrophotographic photoconductor according to claim 1;

a charger configured to charge a surface of the electrophotographic photoconductor;

an irradiator configured to irradiate the charged surface of the electrophotographic photoconductor with light to form an electrostatic latent image;

a developing device containing a toner, configured to develop the electrostatic latent image with the toner to form a visible image; and a transfer device configured to transfer the visible image onto a recording medium.

6. A process cartridge comprising:

the electrophotographic photoconductor according to claim 1; and at least one member selected from:

a charger configured to charge a surface of the electrophotographic photoconductor;

an irradiator configured to irradiate the charged surface of the electrophotographic photoconductor with light to form an electrostatic latent image;

a developing device containing a toner, configured to develop the electrostatic latent image with the toner to form a visible image; and a transfer device configured to transfer the visible image onto a recording medium.

* * * * *